US010774619B2

(12) United States Patent
Nesgaard

(10) Patent No.: US 10,774,619 B2
(45) Date of Patent: Sep. 15, 2020

(54) DOWNHOLE COMPLETION SYSTEM

(71) Applicant: Welltec Oilfield Solutions AG, Zug (CH)

(72) Inventor: Carsten Nesgaard, Allerød (DK)

(73) Assignee: Welltec Oilfield Solutions AG, Zug (CH)

( * ) Notice: Subject to any disclaimer, the term of this patent is extended or adjusted under 35 U.S.C. 154(b) by 135 days.

(21) Appl. No.: 15/926,164

(22) Filed: Mar. 20, 2018

(65) Prior Publication Data

US 2018/0274336 A1 Sep. 27, 2018

(30) Foreign Application Priority Data

Mar. 21, 2017 (EP) ..... 17162048

(51) Int. Cl.

| | |
|---|---|
| ***E21B 41/00*** | (2006.01) |
| ***E21B 47/01*** | (2012.01) |
| ***E21B 47/12*** | (2012.01) |
| ***E21B 47/10*** | (2012.01) |
| ***E21B 47/06*** | (2012.01) |

(52) U.S. Cl.

CPC ..... *E21B 41/0085* (2013.01); *E21B 47/01* (2013.01); *E21B 47/06* (2013.01); *E21B 47/10* (2013.01); *E21B 47/12* (2013.01)

(58) Field of Classification Search

CPC ..... E21B 41/0085; E21B 47/01; E21B 47/10; E21B 47/12; E21B 47/06

See application file for complete search history.

(56) References Cited

U.S. PATENT DOCUMENTS

| | | | | |
|---|---|---|---|---|
| 6,324,904 | B1 | 12/2001 | Ishikawa et al. | |
| 6,408,943 | B1 | 6/2002 | Schultz | |
| 6,443,228 | B1 | 9/2002 | Arenstam | |
| 7,602,668 | B2 * | 10/2009 | Liang | E21B 47/124 367/25 |
| 9,562,988 | B2 * | 2/2017 | Wilson | |
| 2007/0150565 | A1 * | 6/2007 | Ayyagari | H04L 67/12 709/223 |

(Continued)

FOREIGN PATENT DOCUMENTS

| | | |
|---|---|---|
| CN | 104179495 A | 12/2014 |
| EP | 2 642 066 | 9/2013 |

(Continued)

OTHER PUBLICATIONS

Extended European Search Report for EP17162048.7 dated Sep. 13, 2017, 9 pages.

(Continued)

*Primary Examiner* — Jennifer H Gay
(74) *Attorney, Agent, or Firm* — Nixon & Vanderhye P.C.

(57) ABSTRACT

The present invention relates to a downhole completion system for completing a well having a borehole, said downhole completion system comprising a well tubular metal structure arranged in the borehole forming an annulus and comprising a wall and a plurality of sensor units forming a mesh network, wherein at least a number of said sensor units is provided with a self-powering device configured to harvest energy downhole. Furthermore, the present invention relates to a sensor unit for use with a downhole completion system according to the present invention.

21 Claims, 6 Drawing Sheets

(56) References Cited

U.S. PATENT DOCUMENTS

2008/0106972 A1* 5/2008 Liang ..... E21B 47/12 367/25
2009/0027227 A1 1/2009 Wilson
2009/0065258 A1 3/2009 Hamilton
2009/0169364 A1* 7/2009 Downton ..... B22D 15/00 415/118
2010/0223988 A1 9/2010 Crow et al.
2011/0186290 A1* 8/2011 Roddy ..... E21B 43/25 166/253.1
2011/0192592 A1* 8/2011 Roddy ..... E21B 47/01 166/250.01
2011/0199228 A1* 8/2011 Roddy ..... E21B 33/13 340/856.4
2014/0095102 A1* 4/2014 Potyrailo ..... G01R 27/28 702/127
2014/0251600 A1 9/2014 Scott et al.
2014/0354443 A1* 12/2014 Roberson ..... E21B 47/122 340/853.2
2014/0367092 A1* 12/2014 Roberson ..... E21B 47/00 166/250.01
2015/0106972 A1 4/2015 English
2015/0330212 A1* 11/2015 Sassi ..... E21B 47/065 166/250.1
2015/0369951 A1* 12/2015 San Martin ..... G01V 3/28 324/339
2016/0010448 A1 1/2016 Chen
2016/0108728 A1* 4/2016 Freese ..... E21B 47/122 166/250.01
2016/0178785 A1* 6/2016 Wilson ..... G01V 3/265 324/324
2016/0187525 A1* 6/2016 Wilson ..... G01V 3/30 702/6
2016/0266269 A1* 9/2016 Wilson ..... G01V 3/108
2017/0145819 A1* 5/2017 Maida, Jr. ..... E21B 47/12
2018/0058202 A1* 3/2018 Disko ..... E21B 47/011
2018/0210438 A1* 7/2018 Ashar ..... G05B 15/02
2018/0274336 A1* 9/2018 Nesgaard ..... E21B 41/0085
2018/0274353 A1* 9/2018 Nesgaard ..... E21B 47/065
2018/0274354 A1* 9/2018 Nesgaard ..... E21B 47/124
2018/0274356 A1* 9/2018 Hazel ..... E21B 33/13
2018/0348389 A1* 12/2018 Jaaskelainen ..... E21B 41/0035
2019/0013957 A1* 1/2019 Ashar ..... H04L 12/282
2019/0186260 A1* 6/2019 Sarac ..... E21B 47/14
2020/0088023 A1* 3/2020 Gooneratne ..... E21B 49/006

FOREIGN PATENT DOCUMENTS

EP 3379022 A1 * 9/2018 ..... E21B 33/14
EP 3379024 A1 * 9/2018 ..... E21B 47/02
EP 3379025 A1 * 9/2018 ..... E21B 41/0085
WO WO-0206628 A1 * 1/2002 ..... E21B 7/061
WO WO 2013/169255 A1 11/2013
WO WO 2016/185235 11/2016

OTHER PUBLICATIONS

International Preliminary Report on Patentability dated Oct. 3, 2019 in International Application No. PCT/EP2018/056924, 8 pages.
U.S. Office Action dated May 19, 2020 in U.S. Appl. No. 15/926,030 citing U.S. Patent Publication Nos. 2014/0169171, published Jun. 19, 2014 of Acker et al. and 2014/0233375, published Aug. 21, 2014 of Thubert et al., 14 pages.
Nesgaard, Carsten, U.S. Appl. No. 15/926,007, filed Mar. 20, 2018, entitled "Downhole Sensor System".
Nesgaard, Carsten, U.S. Appl. No. 15/926,030, filed Mar. 20, 2018, entitled "Downhole Drilling System".

* cited by examiner

DOWNHOLE COMPLETION SYSTEM

This application claims priority to EP Patent Application No. 17162048.7 filed Mar. 21, 2017, the entire contents of which are hereby incorporated by reference.

The present invention relates to a downhole completion system for completing a well having a borehole. Furthermore, the present invention relates to a sensor unit for use with a downhole completion system according to the present invention.

Various methods and systems for monitoring a well and the production have been proposed over the years. However, so far these methods are associated with a number of drawbacks. For example, it has been suggested to monitor downhole conditions using a submerged tool which is retrieved to download the data. The tool may be arranged in order to measure downhole parameters such as pressure, temperature, position etc. Such parameters may also be of great importance during completion and during production. As is evident, these solutions may only monitor downhole conditions during the time span in which the monitoring tool is positioned at the specific location downhole. When the tool is to measure parameters, e.g. 10 km from the top, the tool needs to emerge to surface every time data needs to be unloaded. Prior art tools are only capable of sending control signals to the tool via a wireline powering the tool when the tool is several kilometres down the well. Prior art tools cannot perform real time monitoring of a well over many years, both due to the lack of sufficient uploading possibilities and since the tool needs power, and the wireline cannot stay in the well as this hinders production.

In order to solve the problem associated with running monitoring equipment downhole, and to allow for a more permanent monitoring, sensor systems have been developed. These sensors are positioned downhole and may provide monitoring independently of the presence of any downhole tool. These sensors may either be powered by an external power supply, such as a wireline, or by an embedded battery. While the wired alternative requires the undesired need for long cables, the stand-alone battery-powered alternative suffers from a limited operating time.

Hence, it would be advantageous to provide an improved system and method enabling monitoring of downhole conditions over a longer period of time.

It is an object of the present invention to wholly or partly overcome the above disadvantages and drawbacks of the prior art. More specifically, it is an object to provide an improved method and system for monitoring of downhole conditions for a longer period of time.

The above objects, together with numerous other objects, advantages and features, which will become evident from the below description, are accomplished by a solution in accordance with the present invention by a downhole completion system for completing a well having a borehole, said downhole completion system comprising:

- a well tubular metal structure arranged in the borehole forming an annulus and comprising:
  - a wall, and
  - a plurality of sensor units forming a mesh network, wherein at least a number of said sensor units is provided with a self-powering device configured to harvest energy downhole.

By having a mesh network of sensor units having a self-powering device configured to harvest energy downhole, any kind of tool without a wireline or any kind of sensor module can be more permanently arranged in the well as measured data is sent to surface using the mesh network when there is data to be sent. In the meantime, the self-powering device harvests energy downhole and accumulates enough energy to be able to receive and transmit when the next set of data is to be communicated to surface.

Thus, the plurality of sensor units forming a mesh network provides for a reliable data path even though at least some of the sensor units are out of range from the data collection provided at surface or at seabed level.

The self-powering device may be configured to harvest energy downhole from fluid flowing in the well.

Said self-powering device may be configured to harvest energy downhole from fluid flowing in the annulus and/or in the well tubular metal structure.

Moreover, the sensor units may be arranged at least partly in the wall of the well tubular metal structure.

Further, the sensor units having a transmitting and receiving distance and the sensor units may be arranged with a mutual distance of half the transmitting and receiving distance.

The self-powering device may be configured to convert kinetic energy to electrical energy.

Moreover, the self-powering device may comprise a vibrating member.

Also, the self-powering device may comprise a piezoelectric member.

Further, the self-powering device may comprise a magnetostrictive member.

In addition, the self-powering device may comprise a thermoelectric generator.

Furthermore, the self-powering device may further comprise at least one capacitor.

Each sensor unit may be configured to receive wirelessly transmitted data from an adjacent sensor unit, and to forward the received data to adjacent sensor units.

The downhole completion system according to the present invention may further comprise a surface system configured to receive downhole data from said sensor units.

The surface system may be at least partly arranged at the seabed level.

Moreover, said surface system may further be configured to determine the position of at least one sensor unit.

Further, the surface system may be configured to determine the position of at least one sensor unit by Monte Carlo simulation and/or Shortest Path simulation and/or acoustic pinging time of flight.

Also, the mesh network may be a self-healing mesh network.

Furthermore, the sensor units may use the inside of the well tubular metal structure as a waveguide for communication between the sensor units.

At least one of said sensor units may comprise a sensor for measuring one or more conditions of the well fluid surrounding the well tubular metal structure.

Further, each one of said sensor units may comprise at least one detector.

Additionally, the detector may comprise an accelerometer and/or a magnetometer, and position data may comprise inclination and/or azimuth.

Moreover, at least one of said sensor units may be positioned in the annulus formed between the well tubular metal structure and a borehole wall.

Cement characteristics may comprise acoustic impedance, and the detector may comprise a transducer for measuring a reflected signal for determining the acoustic impedance.

In addition, the detector of at least one of said sensor units may be configured to detect borehole characteristics such as flow conditions and/or water content.

The downhole completion system according to the present invention may further comprise a sensor module comprising additional sensors.

Said sensor module may comprise a temperature sensor and/or a pressure sensor and/or a flow condition sensor and/or a water content sensor.

Also, the well tubular metal structure may further comprise annular barriers, each annular barrier comprising:

- a tubular metal part having an expansion opening and being mounted as part of the well tubular metal structure, and
- an expandable metal sleeve surrounding and connected with the tubular metal part, and the expandable metal sleeve being expandable by means of fluid entering through the expansion opening.

Furthermore, the well tubular metal structure may further comprise flow devices.

The well tubular metal structure may comprise several lateral well tubular metal structures.

The downhole completion system according to the present invention may further comprise a downhole autonomous tool configured to move within the well tubular metal structure, the downhole autonomous tool comprising a communication unit configured to communicate with the sensor units for sending information to surface via the network of sensor units.

The present invention also relates to a sensor unit for use with a downhole completion system as described above, wherein said sensor unit may be provided with a self-powering device configured to harvest energy downhole.

It should be noted, that within this specification, the term "mesh network" should be interpreted as a network of which each associated sensor forms a network node being configured to relay data for the network. All network sensors thus cooperate in the distribution of data in the network. In a mesh network within the context of this specification, data transfer is accomplished by routing data between the sensors until the data reaches its destination. The data path is not constant, but it is re-routed if any existing sensors are unavailable.

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

In the following description a downhole completion system 100 will be described, and in particular sensor units 10 forming a mesh network 130 for use with such downhole completion system 100 will be described.

Figures 1, 1A:
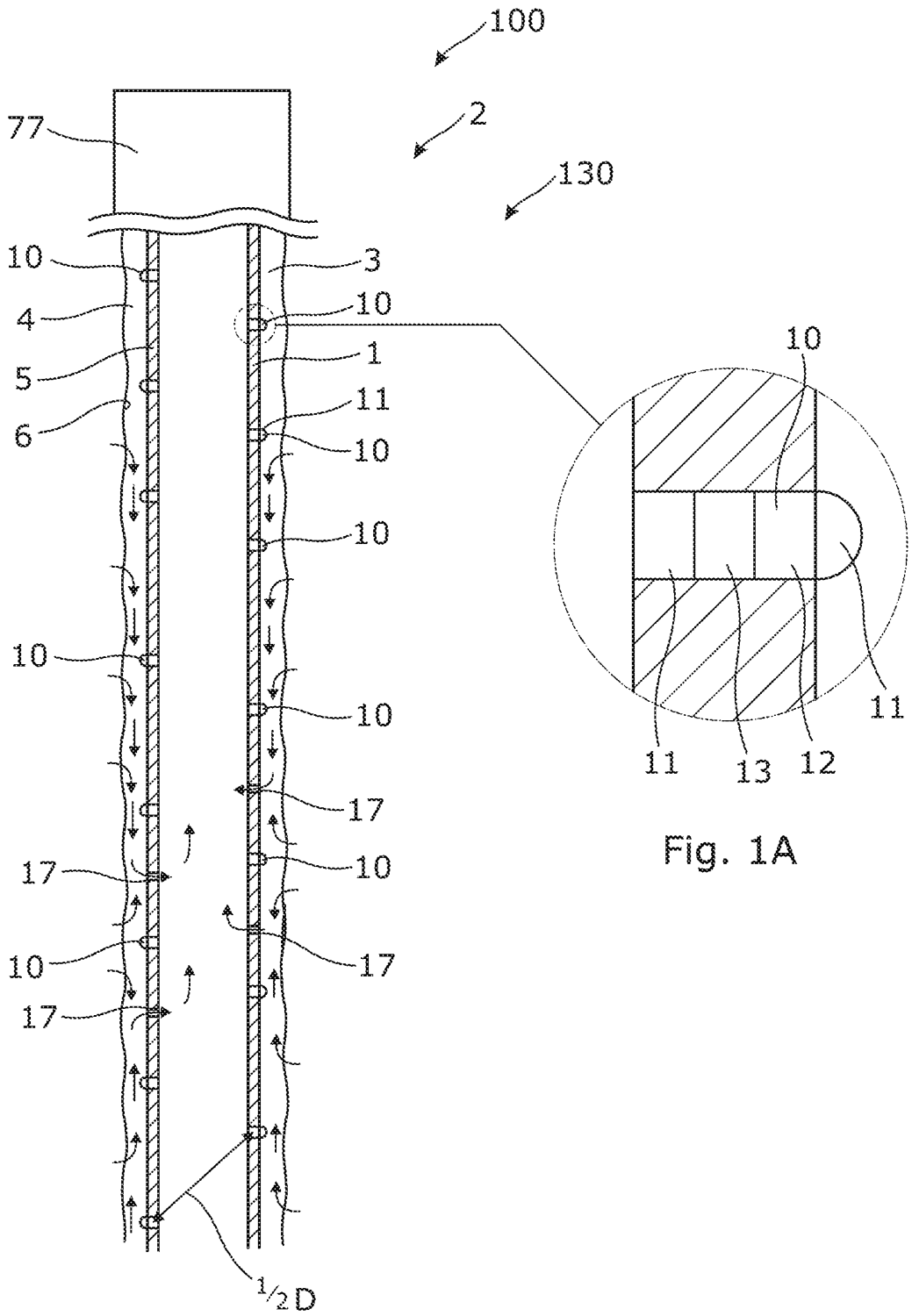
FIG. 1 shows a downhole completion system.
FIG. 1A shows an enlarged view of one of the sensor units in FIG. 1.

FIG. 1 shows a downhole completion system 100 for completing a well 2 having a borehole 3. The downhole completion system comprises a well tubular metal structure 1 arranged in the borehole forming an annulus 4 between a wall 6 of the borehole and the well tubular metal structure 1. The well tubular metal structure has a wall 5 and comprises a plurality of sensor units 10 forming the mesh network 130. At least a number of said sensor units 10 is provided with a self-powering device 11 configured to harvest energy downhole in order that the mesh network in the downhole completion system is self-powering over time. The self-powering device 11 is configured to harvest energy downhole from fluid flowing in the well, e.g. during production, but also during fracking, wash-out and/or cementing operations. Thus, the self-powering device 11 is configured to harvest energy downhole from fluid flowing in the annulus and/or in the well tubular metal structure. As shown in FIG. 1, the sensor units 10 are arranged at least partly in the wall of the well tubular metal structure and are thus able to harvest energy from the fluid flowing in the annulus, as indicated by the arrows, before the fluid enters through openings 17 in the well tubular metal structure. An enlarged view of one of the sensor units 10 is shown in FIG. 1A.

The sensor units 10 have a transmitting and receiving distance D which is the distance over which the sensor units are able to reach out to transmit and receive signals/data from an adjacent sensor unit. Thus, the transmitting and receiving distance D is the distance between two sensor units which are able to communicate with each other, i.e. transmit data/signals to each other and receive data/signals from each other. The sensor units 10 are arranged with a mutual distance of half the transmitting and receiving distance. In this way, each sensor unit is capable of sending data/signals to an adjacent sensor unit and to the neighbour of the adjacent sensor unit, so that if the adjacent sensor unit is not functioning, the sensor unit can send data/signals past the adjacent sensor unit to the neighbour on the other side of that adjacent sensor unit, and the mesh network is established without the dysfunctional sensor unit. In this way, information can still be sent upwards towards the top 77 of the well and/or downwards towards the bottom of the well.

Figures 2, 2A:
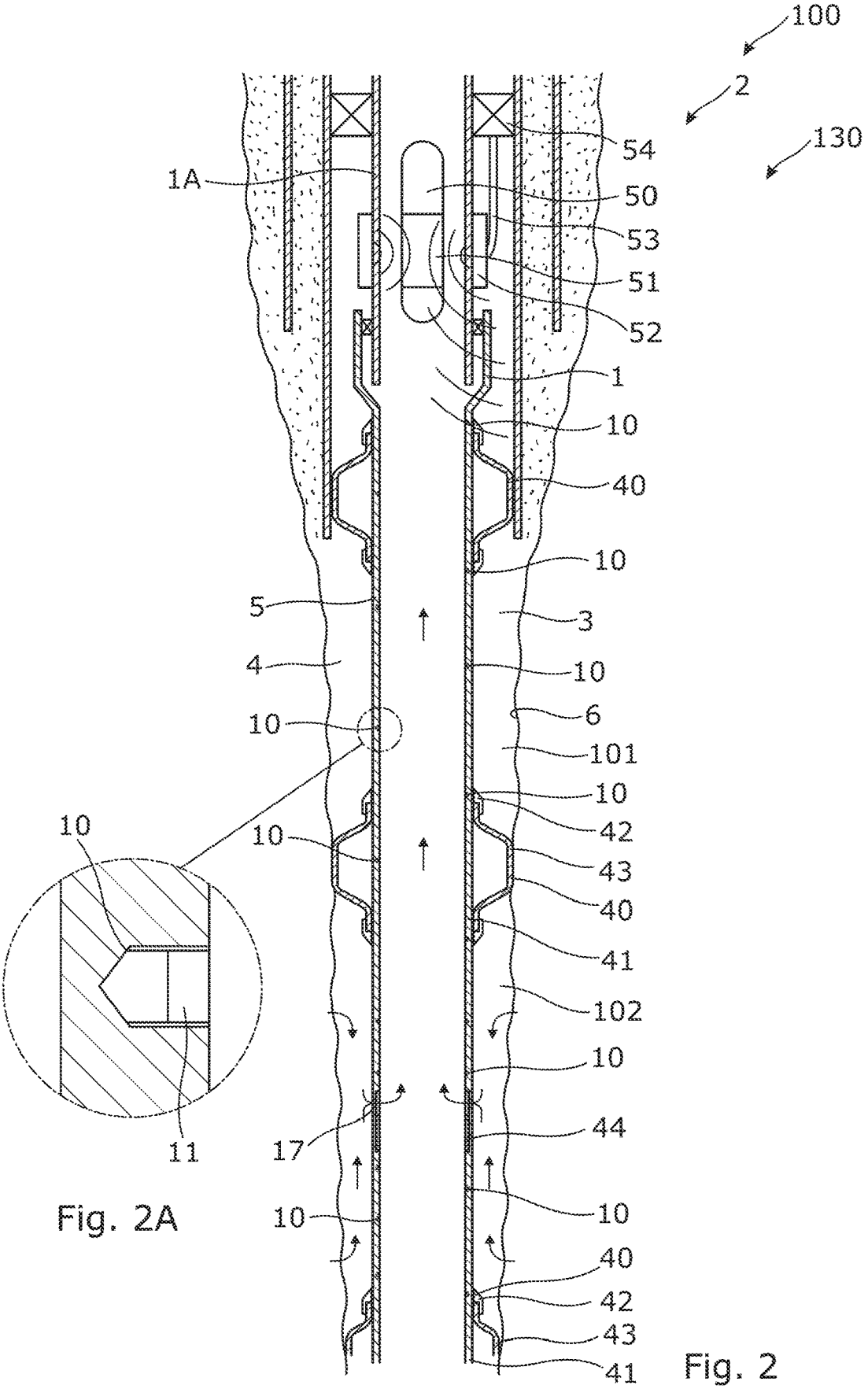
FIG. 2 shows a downhole completion system with a downhole autonomous tool.
FIG. 2A shows an enlarged view of one of the sensor units of FIG. 2.

In FIG. 2, the downhole completion system 100 further comprises annular barriers 40 for isolating a first zone 101 from a second zone 102. Each annular barrier comprises a tubular metal part 41 having an expansion opening 42. The tubular metal part 41 is mounted as part of the well tubular metal structure 1. Each annular barrier further comprises an expandable metal sleeve 43 surrounding and connected with the tubular metal part. The expandable metal sleeve is configured to be expanded by means of fluid entering through the expansion opening 42, e.g by pressurising the well tubular metal structure from within and thus expanding several expandable metal sleeves substantially simultaneously, or by isolating a zone opposite the expansion opening by means of an expansion tool or a drill pipe with cups. The well tubular metal structure further comprises a flow device 44 arranged in the second zone so that fluid from that zone may enter through the opening 17, when the flow device is in its open position as shown in FIG. 2. The sensor units are arranged partly in the wall of the well tubular metal structure, as shown in the enlarged view FIG. 2A, but the self-powering device 11 does not have fluid contact with the fluid in the annulus. The self-powering device 11 of each sensor unit 10 harvests energy downhole from fluid flowing in the well tubular metal structure.

The downhole completion system 100 of FIG. 2 further comprises a downhole autonomous tool 50 configured to move within the well tubular metal structure 1. The downhole autonomous tool comprises a communication unit 51 configured to communicate with the sensor units for sending information to surface via the network of sensor units 10. In FIG. 2, the downhole completion system 100 comprises a downhole power supply unit 52 which is arranged on the outer face of the well tubular metal structure and is powered through a cable 53 from surface through the main barrier 54. The downhole autonomous tool 50 is thus able to be powered up before entering the well in order to complete an operation. The downhole autonomous tool 50 may, as it submerges or later emerges, download or transmit information/data and/or power to or from the sensor units. The well tubular metal structure 1 has, at its top, a receptacle into which a second well tubular metal structure is inserted. The main barrier is arranged above the receptacle and provides a barrier against the second well tubular metal structure 1A, so that the well tubular metal structures can move in relation to each other.

To save power in each sensor unit, the sensor units may enter into "beacon mode" in which the network, at regular predetermined time intervals, wakes up and controls if any signals need to be communicated to another neighbouring sensor unit. Thus, the sensor units are programmed with a delay between each beacon ping.

Figure 3:
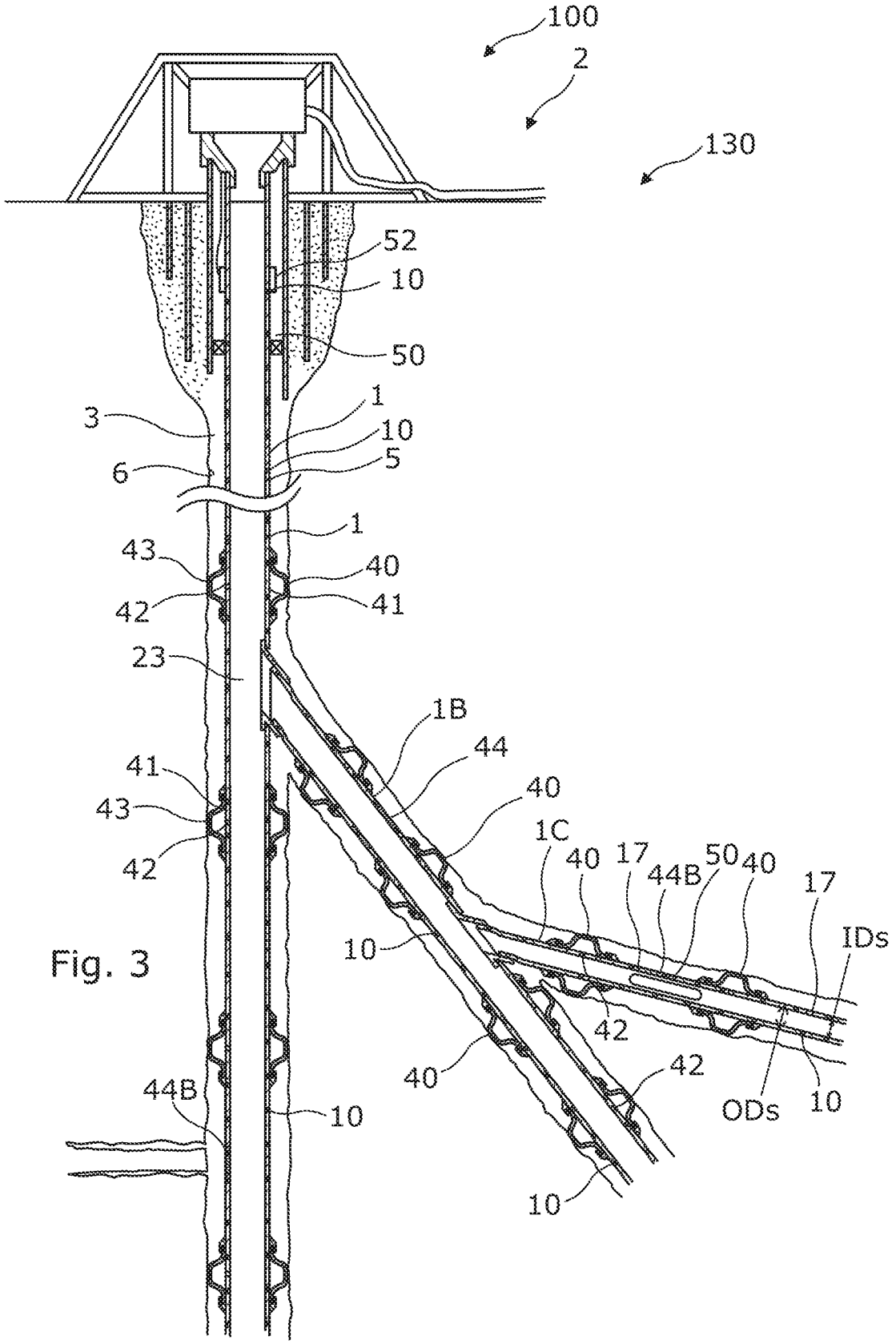
FIG. 3 shows a downhole completion system having laterals.

In FIG. 3, the well tubular metal structure 1 of the downhole completion system 100 comprises several lateral well tubular metal structures 1B, 1C. The downhole autonomous tool 50 is situated in one of the lateral well tubular metal structures 1C, and while the downhole autonomous tool 50 performs an operation or after the operation, the downhole autonomous tool 50 sends up information through the mesh network 130 of sensor units 10. In this way, the downhole autonomous tool 50 is able to remain in the lateral well tubular metal structure and it will not have to emerge to the top of the well between two operations to unload data. Furthermore, the downhole autonomous tool 50 can be arranged in the lateral well tubular metal structure for a very long period of time and may activate itself every 6 months, measure some characteristics of its surroundings, e.g. temperature, pressure and flow density, and send the measured data to surface if some characteristics have changed, and then enter into "sleep mode" for a new period of e.g. 6 months. When the downhole autonomous tool 50 lacks power it emerges and re-loads in the downhole power supply unit 52. The emergence of the downhole power supply unit 52 is assisted by the production fluid entering through the openings 17 or through the flow devices 44 in the well tubular metal structure. The mesh network of sensor units forms a network when required, and in the meantime, the sensor units harvest energy. Thus, the harvesting process does not need to be very efficient since the downhole completion system only uses the mesh network for a short period of time. Furthermore, the mesh network is formed when required so that non-functioning sensor units are skipped.

As will be explained in the following, this is realised by configuring the sensor units 10 to establish a physically distributed independent and localised sensing network, preferably with peer-to-peer communication architecture. As will be understood from the following description, the mesh network being established by the sensor units 10 as a self-healing mesh network, will automatically provide for a reliable and self-healing data path, even though at least some of the sensor units 10 are out of range from the final destination, i.e. the data collection provided at the surface level.

In FIG. 3, a yet further example of the use of a downhole completion system 100 is shown. Here, the sensor units 10 are arranged at the well tubular metal structure wall, either on the inner side, the outer side, or embedded within the downhole completion wall. The sensor units 10 are arranged at the downhole completion in order to form a "smart casing/liner", i.e. to provide information to the surface relating to well characteristics along the borehole over time. As will be explained in the following, this is realised by configuring the sensor units 10 to establish a physically distributed independent and localised sensing network, preferably with peer-to-peer communication architecture.

Figure 4:
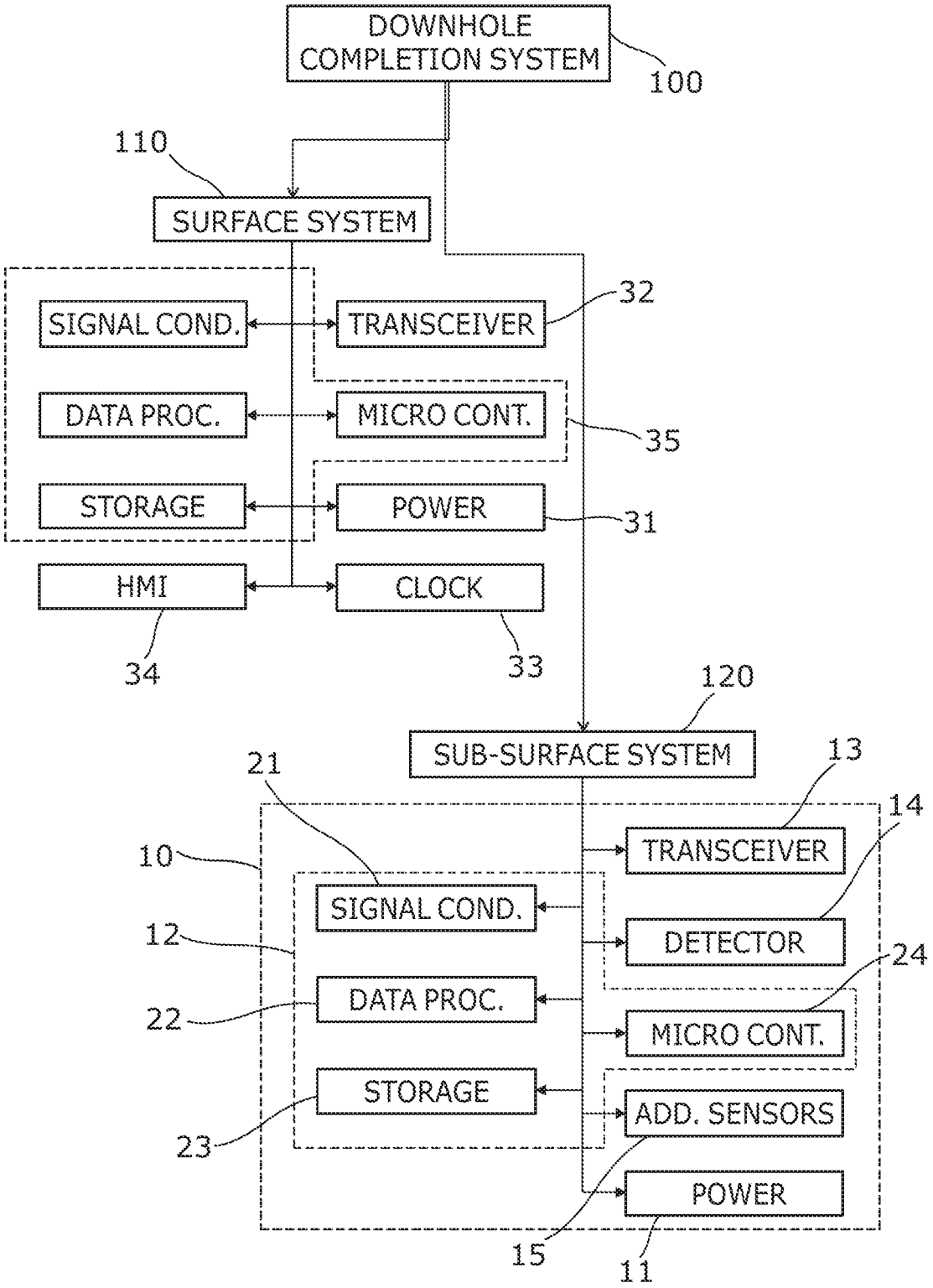
FIG. 4 is a schematic view of a downhole completion system.

All sensor units 10 are preferably identical, although provided with a unique ID. An example of a downhole completion system 100 is schematically shown in FIG. 4. The downhole completion system 100 comprises a surface system 110 and a sub-surface system 120. The sub-surface system 120 comprises a plurality of sensor units 10, although only one sensor unit 10 is shown in FIG. 4. Each sensor unit 10 is provided with a number of components configured to provide various functionality to the sensor unit 10. As shown in FIG. 4, each sensor unit 10 includes a power supply in the form of a self-powering device 11, a digital processing unit 12, a transceiver 13, and optionally a detector 14 and a sensor module 15 comprising additional sensors. For at least one sensor unit 10, the power supply is formed by means of a self-powering device 11 (POWER in FIG. 4) as will be explained in more detail below. Preferably, all sensor units 10 are provided with a self-powering device.

Figure 5:
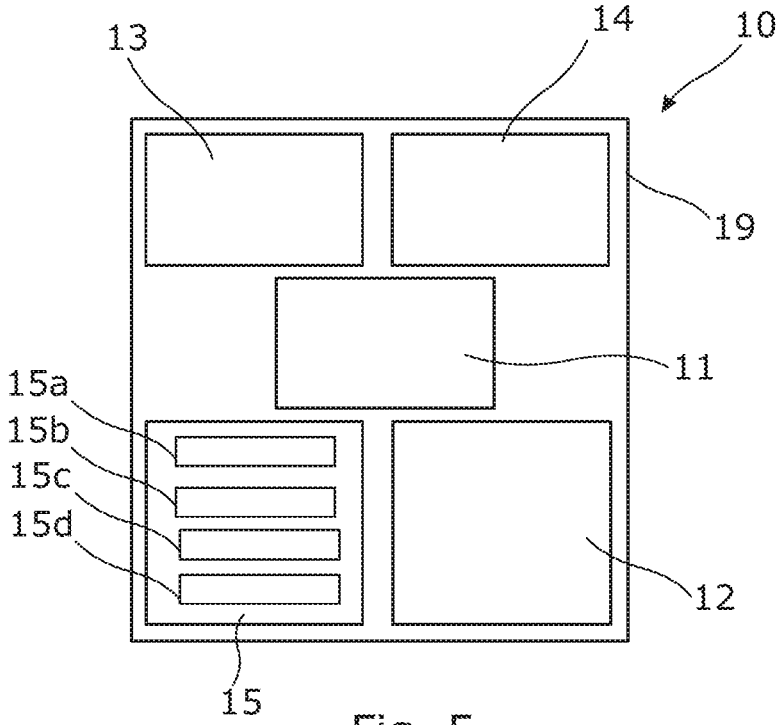
FIG. 5 is a schematic view of a sensor unit for use with a downhole completion system.

As shown in FIG. 5, the sensor module 15 may e.g. comprise a temperature sensor 15*a* and/or a pressure sensor 15*b* and/or a flow condition sensor 15*c* and/or a water content sensor 15*d*. The detector 14 can for example be used together with the digital processing unit 12 to form a detecting unit for determining position data of the sensor unit 10. The detector 14 may, in such embodiments, comprise an accelerometer and/or a magnetometer and/or a transducer. By providing a transducer as the detector 14, it is possible to determine specific characteristics of the surroundings, such as cement integrity etc.

The power supply in the form of the self-powering device 11 is configured to supply power to the other components 12-15 of the sensor unit 10 by converting energy of the surrounding environment to electrical energy.

The digital processing unit 12 of FIG. 4 preferably comprises a signal conditioning module 21, a data processing module 22, a data storage module 23 (STORAGE in FIG. 4) and a micro controller 24. The digital processing unit 12 is configured to control operation of the entire sensor unit 10, as well as temporarily storing sensed data in the memory of the data storage module 23.

The transceiver 13 is configured to provide wireless communication with transceivers of adjacent sensor units 10. For this, the transceiver 13 comprises a radio communication module and an antenna. The radio communication module may be configured to communicate according to well-established radio protocols, e.g. IEEE 801.1aq (Shortest Path Bridging), IEEE 802.15.4 (ZigBee) etc. The radio communication module may also be configured to position the sensor units in relation to each other, i.e. configured to perform a distance measurement.

The surface system 110 also comprises a number of components for providing the desired functionality of the entire downhole completion system 100. As is shown in FIG. 4, the surface system 110 has a power supply 31 for providing power to the various components. As the surface system 110 may be permanently installed, the power supply 31 may be connected to mains power, or it may be formed by one or more batteries. The surface system 110 also comprises a transceiver 32 for receiving data communicated from the sensor units 10, and also for transmitting data and control signals to the sensor units 10. Hence, the transceiver 32 is provided with a radio communication module and an antenna for allowing for communication between the surface system 110 and the sensor units 10 of the sub-surface system 120. The surface system 110 also comprises a clock 33, a human-machine interface 34, and a digital processing unit 35. The digital processing unit 35 comprises the same functionality as the digital processing unit 12 of the sensor unit 10, i.e. a signal conditioning module, a data processing module, a data storage module, and a micro controlling module.

Figure 6:
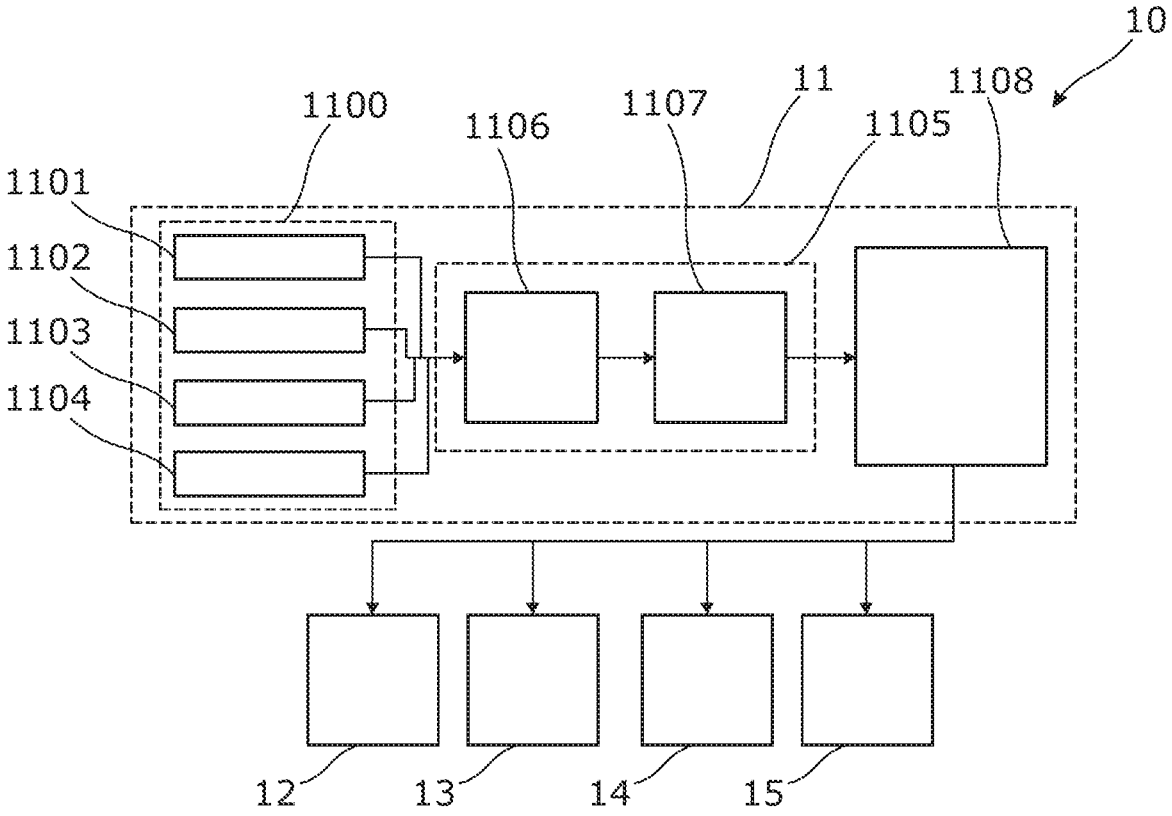
FIG. 6 is a schematic view of a self-powering device of a sensor unit.

Before describing the operation of the downhole completion system 100, a sensor unit 10 is schematically shown in FIGS. 5 and 6. The sensor unit 10 has a housing 19 which is configured to enclose the components previously described, as well as to form a protection which is capable of withstanding any impact, e.g. with potential collisions with the borehole wall 6. Although shown as rectangular, the shape of the housing 19 may of course be chosen differently. For example, it may be advantageous to provide the housing 19 with only rounded corners. The housing 19 may for such embodiment have a spherical shape. Inside the housing 19, the following is fixedly mounted: the self-powering device 11, the digital processing unit 12, the transceiver 13, the detector 14 and optionally the sensor module 15.

In FIG. 6, the self-powering device 11 is shown in further detail. The self-powering device 11 is configured to provide electrical power to the various electrical components of the sensor unit 10 by harvesting energy from the downhole environment. The self-powering device 11 therefore comprises an energy harvesting module 1100. The harvesting module 1100 may be selected from the group comprising a vibrating member 1101, a piezoelectric member 1102, a magnetostrictive member 1103, and a thermoelectric generator 1104. As is shown in FIG. 6, any of these members is possible. In case of using a vibrating member 1101, a piezoelectric member 1102 or a magnetostrictive member 1103, the energy harvesting module 1100 is configured to convert mechanical vibrations of the surrounding environment, such as in the well tubular metal structure or in downhole fluid, to electrical energy. In case of using a thermoelectric generator 1104, such as a Peltier element, the harvesting module 1100 is configured to convert thermal energy of the surrounding energy to electrical energy.

The harvested energy is preferably supplied to a rectifier 1105. The rectifier 1105 is configured to provide a direct voltage and comprises a switching unit 1106 and a rectifier 1107. It should be noted that the position of the switching unit 1106 and the rectifier 1107 could be changed, in order that the rectifier 1107 is directly connected to the harvesting module 1100. As is shown in FIG. 6, the rectifier 1107 is preferably connected to a capacitor 1108 for storing the harvested energy. The electrical components 12-15 of the sensor unit 10 are therefore connected to the capacitor 1108 forming the required power source or storage buffer. Optionally, the self-powering device 11 is further provided with an amplifier (not shown) and/or with control electronics (not shown) for the switching unit 1106. Additional capacitors may also be provided.

Now turning to FIG. 7, the configuration of the downhole completion system will be described further, and in particular the downhole or sub-surface system 120 will be described. The sensor units 10A-F, representing parts of a sub-surface system 120, are arranged at the well tubular metal structure wall. The communication between the sensor units 10A-F is preferably based on a relay model, which means that the surface system communicates with the sensor units 10A-F via a sensor unit network. Preferably, each signal that is transmitted from a sensor unit 10A-F comprises information relating to a unique ID of the sensor unit 10A-F. Further, data echoing and cross-talk are reduced by limiting the number of possible re-transmissions between the sensor units 10A-F. By reducing data echoing, the possibility of one sensor unit sending the same data more than once to the same neighbouring sensor unit is eliminated. The network knows its neighbours by their unique IDs, and hereby the transmitter can target the transmission of data, and thus the situation in which data is sent back and forth can be avoided in that the neighbouring sensor unit "knows" from which sensor unit the data is received and will consequently not send that data back again.

Each sensor unit 10A-F is preferably configured to operate in two different modes. The first mode, relating to activation for the purpose of receiving data relating e.g. to the position or trajectory of the borehole or cement or borehole characteristics, preferably comprises a step of gathering data (optionally including data from the additional sensors 15*a*, 15*b* (shown in FIG. 5), and transmitting the data upon request. In the second mode, the sensor units 10A-F are configured to re-transmit received signals.

The location of each sensor unit 10A-F may also be determined by a round-trip elapsed time measured by the surface system 110. The surface system 110 may thus be configured to ping a specific sensor unit 10A-F using the unique ID, whereby the specific sensor unit 10A-F replies by transmitting a response signal with a unique tag. The surface system 110 receives the transmitted signal with elapsed times, and either Monte Carlo simulation and/or Shortest Path simulation may be used to determine the specific position of the sensor unit 10A-F.

Using Monte Carlo simulation, a simulated sensor unit location model may be created having a uniform probability distribution. For such method, it may be possible to assume that the sensor units 10A-F are distributed along a specific borehole or well tubular metal structure length, and that these locations, for a given time, are known in the simulated model. The simulated model also includes a relay model with specific individual sensor processing delays.

For each distribution, the shortest round-trip travel time is calculated for each sensor units 10A-F. This results in a map of travel time versus location of sensor units 10A-F. It is then possible to compare the measured elapsed time with the map to determine the location of the sensor unit 10A-F.

For Shortest Path simulation, once the surface system 110 pings a sensor unit 10A-F, the round-trip times of multiple received signals, each one from a specific relay path, is recorded. The shortest time for the particular sensor unit 10A-F is then determined by calculating the distance from the surface system 110 using the speed of light.

It would also be possible to use the detectors 14 of the sensor units 10A-F for determining the distance between adjacent sensor units 10A-F, especially if the detectors 14 are realised as transducers. As the sonic pulse transmitted by the detector 14 will travel with the speed of sound, more time for computing will be available. Hence the detector 14 is used not only for cement bond evaluation, but also for distance measurements. The radio communication module may also be used for the distance measurements, e.g. in smart mud. All information will, however, be communicated wirelessly using radio frequency. For example, the sensor units 10A-F may be programmed to transmit a signal, via the transceiver, to its neighbouring sensor units 10A-F, whereby the signal contains information that a sonic pulse will be transmitted at a predetermined time, e.g. 10 ms from transmittance of the signal. When one of the neighbouring sensor units 10A-F detects the transmitted sonic pulse, it is possible, for each receiving sensor unit 10A-F, to determine the time elapsed from transmission of the sonic pulse to receipt of the sonic pulse. The time of flight for the acoustic pulse is then converted to a distance between the transmitting sensor unit 10A-F and each receiving sensor unit 10A-F. Absorption based energy consideration and reverberation measurements are other examples of possible implementations for the range estimation between two neighbouring sensor units.

Figure 7:
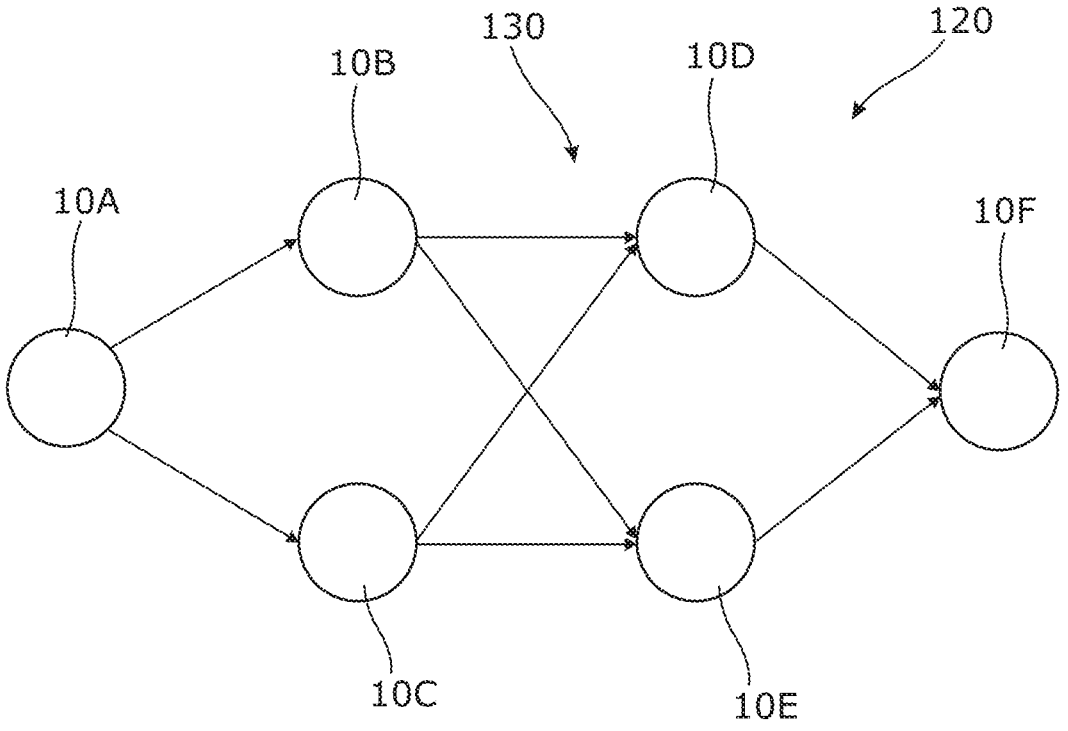
FIG. 7 is a diagram showing data communication between different sensor units of a downhole completion system.

In the example shown in FIG. 7, each sensor unit 10A-F forms a node in the mesh network 130. Each node is configured to receive and transmit data signals, as well as add ID and timestamp with each data package. Each node will send a signal corresponding to its current state (i.e. the detected signals representing cement characteristics) asynchronously with respect to other nodes. In the table below, data communication in the mesh network 130 is explained further. In the table, nX represents the node ID, TnX represents the timestamp for the particular node, and sX represents the sensed data from the particular node.

| Node | Forwarded signal | Received signal |
|---|---|---|
| 10A | nA:TnA:sA | |
| 10B | nB:TnB:nA:TnA:sA | nA:TnA:sA |
| 10C | nC:TnC:nA:TnA:sA | nA:TnA:sA |
| 10D | | nB:TnB:nA:TnA:sA |
| | | nC:TnC:nA:TnA:sA |
| | nD:TnD:nB:TnB:nA:TnA:sA | |
| | nD:TnD:nC:TnC:nA:TnA:sA | |
| 10E | | nB:TnB:nA:TnA:sA |
| | | nC:TnC:nA:TnA:sA |
| | nE:TnE:nB:TnB:nA:TnA:sA | |
| | nE:TnE:nC:TnC:nA:TnA:sA | |
| | | nD:TnD:nB:TnB:nA:TnA:sA |
| | | nD:TnD:nC:TnC:nA:TnA:sA |
| | | nE:TnE:nB:TnB:nA:TnA:sA |
| | | nE:TnE:nC:TnC:nA:TnA:sA |

Accordingly, data is communicated through the mesh network 130 until the signals are received by the surface system 110.

Due to the provision of the self-powering device 11 of the sensor units 10, data may be measured and transmitted to the surface without the need for expensive wires, and the sensor units 10 may operate for a much longer period of time compared to if batteries or other embedded power supplies are used.

By fluid or well fluid is meant any kind of fluid that may be present in oil or gas wells downhole, such as natural gas, oil, oil mud, crude oil, water etc. By gas is meant any kind of gas composition present in a well, completion, or open hole, and by oil is meant any kind of oil composition, such as crude oil, an oil-containing fluid etc. Gas, oil, and water fluids may thus all comprise other elements or substances than gas, oil, and/or water, respectively.

By an annular barrier is meant an annular barrier comprising a tubular metal part mounted as part of the well tubular metal structure and an expandable metal sleeve surrounding and connected to the tubular part defining an annular barrier space.

By a well tubular metal structure, casing or production casing is meant any kind of pipe, tubing, tubular, liner, string etc. used downhole in relation to oil or natural gas production.

In the event that the tool is not submergible all the way into the well tubular metal structure, a downhole tractor can be used to push the tool all the way into position in the well. The downhole tractor may have projectable arms having wheels, wherein the wheels contact the inner surface of the well tubular metal structure for propelling the tractor and the tool forward in the well tubular metal structure. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole completion system for completing a well having a borehole, said downhole completion system comprising:

a well tubular metal structure arranged in the borehole to form an annulus between the well tubular metal structure and the borehole, the well tubular metal structure comprising:

a wall, and a plurality of sensor units forming a mesh network, each of the sensor units being configured to receive a signal from adjacent units and to transmit a signal to adjacent units, wherein at least a number of said plurality of sensor units is provided with a self-powering device configured to harvest energy downhole.

2. A downhole completion system according to claim 1, wherein the plurality of sensor units are arranged at least partly in the wall of the well tubular metal structure.

3. A downhole completion system according to claim 1, wherein the plurality of sensor units have a transmitting and receiving distance and the sensor units are arranged with a mutual distance of half the transmitting and receiving distance.

4. A downhole completion system according to claim 1, wherein the self-powering device of the number of said plurality of sensors is configured to convert kinetic energy to electrical energy.

5. A downhole completion system according to claim 4, wherein the self-powering device comprises a member selected from the group consisting of a vibrating member, a piezoelectric member, and a magnetostrictive member.

6. A downhole completion system according to claim 4, wherein the self-powering device comprises a vibrating member or a piezoelectric member.

7. A downhole completion system according to claim 1, wherein the self-powering device of the number of said plurality of sensors comprises a thermoelectric generator.

8. A downhole completion system according to claim 1, wherein the self-powering device of the number of said plurality of sensors further comprises at least one capacitor.

9. A downhole completion system according to claim 1, wherein each sensor unit of the plurality of sensor units is configured to receive wirelessly transmitted data from adjacent sensor units, and to forward the received data to adjacent sensor units.

10. A downhole completion system according to claim 1, further comprising a surface system configured to receive downhole data from said plurality of sensor units.

11. A downhole completion system according to claim 10, wherein the surface system is configured to determine the position of at least one sensor unit by a process being selected from the group consisting of Monte Carlo simulation, Shortest Path simulation, and acoustic pinging time of flight.

12. A downhole completion system according to claim 1, wherein the mesh network formed by the plurality of sensor units is configured as a self-healing mesh network.

13. A downhole completion system according to claim 1, wherein at least one of said plurality of sensor units comprises a sensor for measuring one or more conditions of the well fluid surrounding the well tubular metal structure.

14. A downhole completion system according to claim 1, wherein the well tubular metal structure further comprises annular barriers, each annular barrier comprising:

a tubular metal part having an expansion opening and being mounted as part of the well tubular metal structure, and an expandable metal sleeve surrounding and connected with the tubular metal part, and the expandable metal sleeve being expandable by means of fluid entering through the expansion opening.

15. A downhole completion system according to claim 1, further comprising a downhole autonomous tool configured to move within the well tubular metal structure, the downhole autonomous tool comprising a communication unit configured to communicate with the plurality of sensor units for sending information to surface via the network of sensor units.

16. A downhole completion system according to claim 1, wherein:

the mesh network is a network on which each associated sensor forms a network node being configured to relay data for the network, whereby all network sensors thus cooperate in the distribution of data in the network, data transfer is accomplished by routing data along a variable data path between the sensors until the data reaches its destination, and the data path is not constant, and is re-routed if any existing sensors are unavailable.

17. A downhole completion system according to claim 1, wherein an originating sensor unit of said sensor units is configured to transmit originating sensor unit data to adjacent sensors, and the adjacent sensors are configured eliminate re-transmission of the originating sensor unit data back to the originating sensor unit, thereby reducing data-echoing and cross-talk.

18. A downhole completion system according to claim 1, wherein each said sensor unit is associated with a unique ID, and data transmitted from a first sensor unit having a first unique ID is not re-transmitted from adjacent sensor units back to the first sensor unit.

19. A downhole completion system according to claim 1, wherein each said sensor unit is configured to receive a ping signal and send a reply signal with a unique tag in response to said ping signal.

20. A downhole completion system according to claim 1, wherein each said sensor unit is configured to transmit one or more signals containing a unique ID, a node timestamp and the sensed data to adjacent sensor units.

21. A downhole completion system according to claim 1, wherein each said sensor unit is configured to transmit sensed data collected from itself in addition to sensed data received from adjacent sensor units.

* * * * *